US005337935A

United States Patent [19]

Chambonnet

[11] Patent Number: 5,337,935

[45] Date of Patent: Aug. 16, 1994

[54] BELT STRUCTURE, PARTICULARLY FOR ACCESSORIES

[75] Inventor: Bernard Chambonnet, Vence, France

[73] Assignee: La Spirotechnique Industrielle et Commerciale, Carros, France

[21] Appl. No.: 100,325

[22] Filed: Aug. 2, 1993

[30] Foreign Application Priority Data

Aug. 21, 1992 [FR] France ..... 92 10179

[51] Int. Cl.[5] ..... A45F 3/00

[52] U.S. Cl. ..... 224/224; 224/262; 2/338

[58] Field of Search ..... 2/336, 338, 339, 311, 2/312, 318, 321, 322; 224/211, 215, 224, 252, 253, 262; 405/186, 187

[56] References Cited

U.S. PATENT DOCUMENTS

| | | | |
|---|---|---|---|
| 2,498,685 | 2/1950 | Hyman . | |
| 3,191,828 | 6/1965 | Senne | 224/211 |
| 3,269,129 | 8/1966 | Zambrano | 405/186 |
| 3,957,183 | 5/1976 | Gadberry | 224/211 |
| 4,310,110 | 1/1982 | Dexter | 224/211 |
| 4,676,418 | 6/1987 | Lowe | 224/215 |
| 4,779,554 | 10/1988 | Courtney | 405/186 |
| 4,919,631 | 4/1990 | Stafford | 405/186 |

FOREIGN PATENT DOCUMENTS 0371886 6/1990 European Pat. Off. .

*Primary Examiner*—Clifford D. Crowder
*Assistant Examiner*—Gloria Hale
*Attorney, Agent, or Firm*—Young & Thompson

[57] ABSTRACT

A belt structure, particularly for carrying diving equipment, comprises a closure strap (2) having at least one free portion (*7a; 7b*) on a surface of which are secured at least two first securement elements (13), typically in the form of loops. A second securement element (14) is carried by a wing of a substantially rigid dorsal carrying element (1), so as to modify the effective length of the free portion according to the different sizes of the users.

10 Claims, 1 Drawing Sheet

BELT STRUCTURE, PARTICULARLY FOR ACCESSORIES

FIELD OF THE INVENTION

The present invention relates to a belt structure comprising a first strap having at least one free portion provided at its end with securement means to close the belt structure and adjustment means of the effective length of the free section.

BACKGROUND OF THE INVENTION

Belt structures, particularly structures of composite belts for carrying accessories, are confronted with conventional problems of the variation of the size of the users. Customarily, two solutions have been adopted: either there are provided different belt structures for different sizes, with the resulting drawback of multiplication of stock and inventory and the lack of versatility of the belt structure for different users of different sizes, or the adaptation to different sizes by means of the securement of the free end of the free portion, with the drawback in use particularly in difficult environments and/or with the use of gloves, as in underwater diving, of manipulation and maintenance of the excessive length of the free portion.

OBJECT OF THE INVENTION

The present invention has for its object to provide a belt structure, particularly for a composite structure for carrying accessories, usable in a difficult environment, particularly for diving, overcoming the above drawbacks, which will be of low cost and easy and comfortable to use.

SUMMARY OF THE INVENTION

To do this, according to a characteristic of the invention, the central portion of the strap is fixed to a central portion of an element having at least one wing extending in the direction of the free portion and in that it comprises at least two first successive securement elements fixed on one surface of the free portion of the first strap and adapted to coact with a second securement element secured to the wing to modify the effective length of the free portion.

According to other characteristics of the invention:

- the belt structure comprises means for containing and maintaining the free portion between the central portion and the first securement elements coacting with the second securement means;
- the first securement elements are constituted of loops, preferably formed by at least one second strap stitched on said surface of the first strap at points spaced from each other;
- the element is substantially rigid and is typically a dorsal bandolier element provided with securement means for an accessory, more particularly dive equipment, the second securement element being supported by the wing of the substantially rigid element and being preferably constituted by a profiled opening formed in said wing.

BRIEF DESCRIPTION OF THE DRAWINGS

Other characteristics and advantages of the present invention will become apparent from the following description, given by way of illustrative but nonlimiting example, with respect to the accompanying drawing, in which.

DETAILED DESCRIPTION OF THE INVENTION

Figure 1:
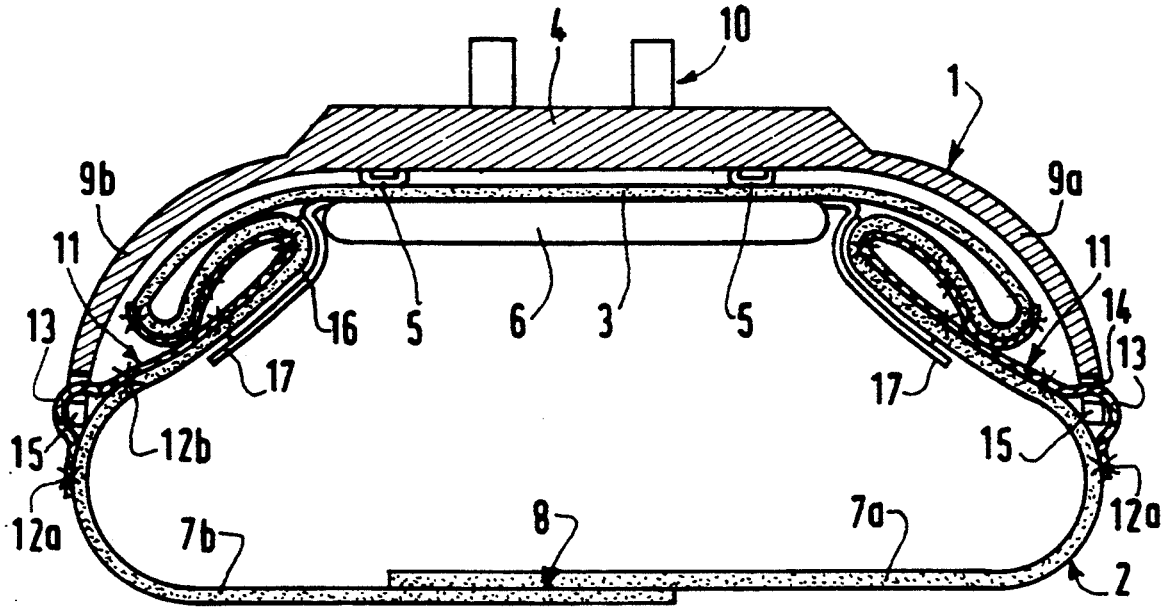
FIGS. 1 and 2 are schematic views of a belt structure for carrying accessories, respectively in a "small size" and "large size" configuration.

As a nonlimiting but preferred example, there is shown in the figures an adjustable belt for carrying a float or jacket for a diver, comprising a substantially rigid element 1 comprising a structural member of plastic material constituting a type of dorsal bandolier. A first closure strap 2 comprises a central (dorsal) portion 3 secured to a central thickened portion 4 of the rigid element 1, for example by fasteners 5. Typically, a backing 6 of flexible material extends over the entire internal surface of the central portion 3 of the strap 2. The central portion 3 of the strap 2 is extended outwardly on at least one side, typically symmetrically on both sides, by a free portion *7a*, *7b*, the ends of the free portions *7a*, *7b* comprising coacting releasible fastening means 8, typically of the rapid attachment type sold under the mark "VELCRO", to close the belt about the user. The rigid element 1 comprises at least one, typically two, wings *9a*, *9b* extending from the central portion 4 and shaped to match at least partially the lumbar region of the user. The central portion 4 comprises mounting means 10 for securement of an accessory (not shown), typically diving equipment, for example an assembly of a float and a compressed air tank.

According to one aspect of the invention, on the external surface of each free portion *7a*, *7b* of the closure strap 2 is connected a strap 11 of smaller transverse dimensions than the strap 2 and stitched on this latter at two substantially equidistant points *12a*, *12b*, . . . *12i* so as to provide between the stitching points a series of attachment loops 13 comprising first successive securement elements adapted to be attached in a predetermined position relative to the central portions 3 and 4, typically by securement to the adjacent wing *9a* or *9b*. To this end, according to one aspect of the invention, the free end of each wing *9a*, *9b* comprises an oblong cutout 14 comprising a second securement element parallel to the straps 2 and 11 and of a principal dimension corresponding to the width of the second strap 11. The cutout 14 opens outwardly through an access passage 15 of a width greater than the thickness of the strap 11 but less than the width of this latter.

Figure 2:
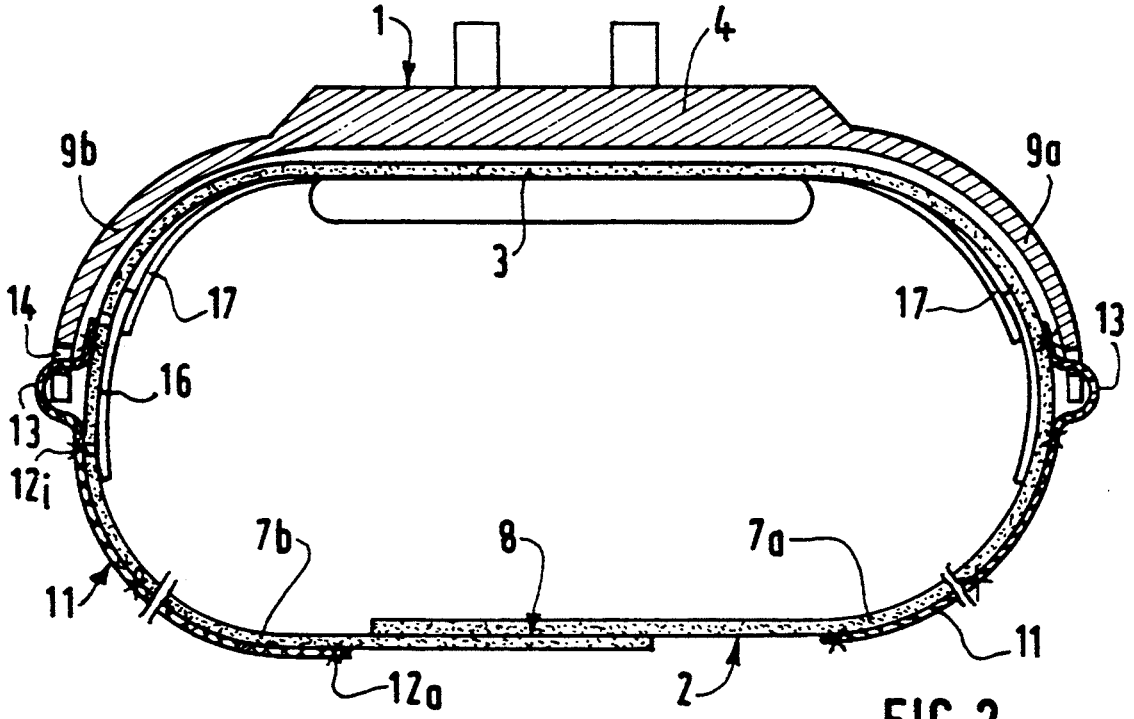
Figure 3:
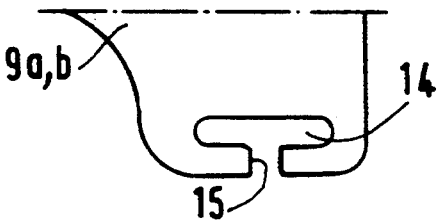
FIG. 3 is a side view, on a larger scale, of the securement opening of the loops for adjusting the effective length of the free portion of the belt structure of FIGS. 1 and 2.

The use of the belt is as follows: as shown in FIGS. 1 and 2, according to the size of the user, the loops 13 are secured in the opening 14 to provide an effective length of free portion *7a* or *7b* adapted to the girth of the user. For the smallest size, the internal portion of the free part is folded on itself (FIG. 1) along the corresponding wing *9a*, *9b* of the rigid element 1.

According to one aspect of the invention, to fix the folded configuration of the free portions and to ensure better comfort of the user, the interior surface of the free portion adjacent to central portion 3 comprises a strap 16 of rapid attachment material trademarked "VELCRO", and a strap 17, provided on its internal surface with "VELCRO" securement elements, extends from the central portion 3 to coact with the strap 16 and thereby maintain the internal folds of the free portion flattened in the "small size" configuration.

Although the present invention has been described with respect to particular embodiments, it is not thereby limited but is on the contrary susceptible to modifications and variations which will be apparent to one skilled in the art. In particular, according to its use, the rigid element 1 can be replaced by a centrally stitched strap on a central portion 3 of the strap-belt 2 and comprising at its free ends securement means and the loops 13.

What I claim is:

1. A belt structure comprising a first strap (2) having a central portion (3) and at least one free portion (*7a*, *7b*) extending from the central portion (3) and having a free end provided with releasable fastening means (8) to fasten the belt structure around a wearer, the free portion including adjusting means (13, 14) for adjusting the effective length of the free portion, the central portion (3) of the first strap (2) being secured to a central portion (4) of a structural member (1) having at least one wing (*9a*, *9b*) extending in the direction of the free portion, and further comprising at least two first successive securement elements (13) fixed on a surface of the free portion of the first strap and adapted to coact with a second securement element (14) secured to the wing to modify the effective length of the free portion.

2. Belt structure according to claim 1, which further comprises means (16, 17) for confinement of the free portion between the central portion (3) and the first securement element (13) coacting with the second securement element (14).

3. Belt structure according to claim 1, wherein the first securement elements are loops (13).

4. Belt structure according to claim 3, wherein the loops (13) are formed by at least one second strap (11) stitched at spaced points (*12i*) on said surface of the first strap (2).

5. Belt structure according to claim 1, wherein the structural member (1) is substantially rigid, the second securement element (14) being supported by the wing (*9a*; *9b*) of the structural member (1).

6. Belt structure according to claim 5, wherein the second securement element is constituted by a shaped opening (14) formed in the wing (*9a*; *9b*).

7. Belt structure according to claim 2, wherein the confinement means comprise a third strap (17) fixed to the central portion (3) of the first strap (2) and comprising rapid attachment means coacting with rapid attachment means (16) fixed on the other surface of the free portion (*7a*, *7b*).

8. Belt structure according to claim 1, wherein said central portion (4) of the structural member (1) comprises mounting means (10) for an accessory.

9. Belt structure according to claim 8, wherein the structural member (1) is of plastic material.

10. Belt structure according to claim 1, which is symmetrical on opposite sides of the central portion (4) of said structural member (1).

* * * * *